US005325930A

United States Patent [19]

Harrison

[11] Patent Number: 5,325,930

[45] Date of Patent: Jul. 5, 1994

[54] OVERCENTER TOGGLE LATCH APPARATUS

[75] Inventor: Simon J. Harrison, Callander, Canada

[73] Assignee: Longyear Company, Salt Lake City, Utah

[21] Appl. No.: 15,632

[22] Filed: Feb. 9, 1993

Related U.S. Application Data

[63] Continuation-in-part of Ser. No. 791,847, Nov. 14, 1991, abandoned.

[51] Int. Cl.[5] ..... E21B 25/02

[52] U.S. Cl. ..... 175/246; 175/249; 175/285

[58] Field of Search ..... 175/244, 246, 248, 260, 175/285; 166/385

[56] References Cited

U.S. PATENT DOCUMENTS

| | | | |
|---|---|---|---|
| 1,364,254 | 1/1921 | Currier . | |
| 2,829,868 | 4/1958 | Pickard et al. | 175/246 |
| 2,857,138 | 10/1958 | Svendsen et al. | 175/246 |
| 2,905,438 | 9/1959 | Church | 175/246 |
| 3,331,439 | 7/1967 | Sanford | 75/285 |
| 3,340,939 | 9/1967 | Lindelof . | |
| 3,513,920 | 5/1970 | Watson | 175/285 |
| 3,757,876 | 9/1973 | Pereau | 175/285 |
| 3,977,482 | 8/1976 | Reed et al. | 175/246 |
| 4,169,510 | 10/1979 | Meigs | 175/285 |
| 4,800,969 | 1/1989 | Thompson | 175/246 |
| 5,020,612 | 6/1991 | Williams | 175/246 X |

*Primary Examiner*—Ramon S. Britts
*Assistant Examiner*—Frank S. Tsay
*Attorney, Agent, or Firm*—Clayton R. Johnson

[57] ABSTRACT

A drilling tool, for example a core barrel inner tube assembly or a drilling bit, is attached to the inner end of a latch body which is removably seatable on a landing shoulder of a drill string. The inner end of the latch body mounts a drilling tool such as a core receiving tool or a drag bit. An overcenter toggle latch assembly is mounted to the latch body, the latch assembly including a pair of latches having inner ends pivotally mounted to the latch body, toggle links that at their one ends are pivotally connected to the outer ends of the latches and at their opposite ends have a retractor link extended through elongated slots. The retractor pin is extended through an axially elongated slot in the latch body to limit the axial movement of the pin between a position that the latches are locked in a latch seated position and a position retracting the latch body and the drilling tool attached thereto. An overshot coupling member and a latch retractor tube are provided for retracting the retractor pin including moving the latch body and the structure depending therefrom outwardly through the drill string.

19 Claims, 3 Drawing Sheets

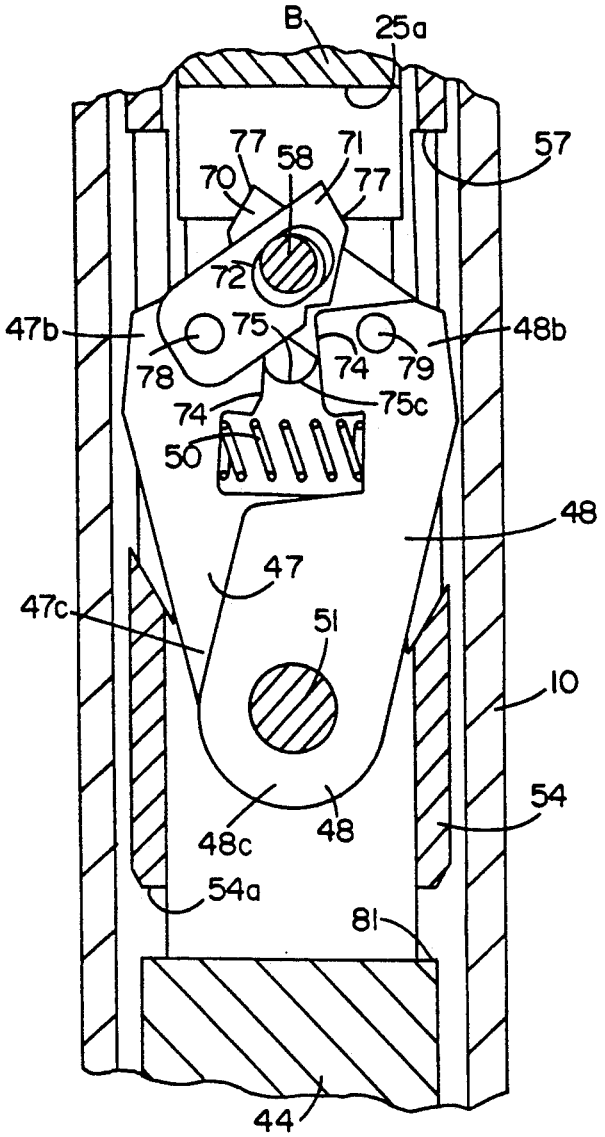
FIG. 4
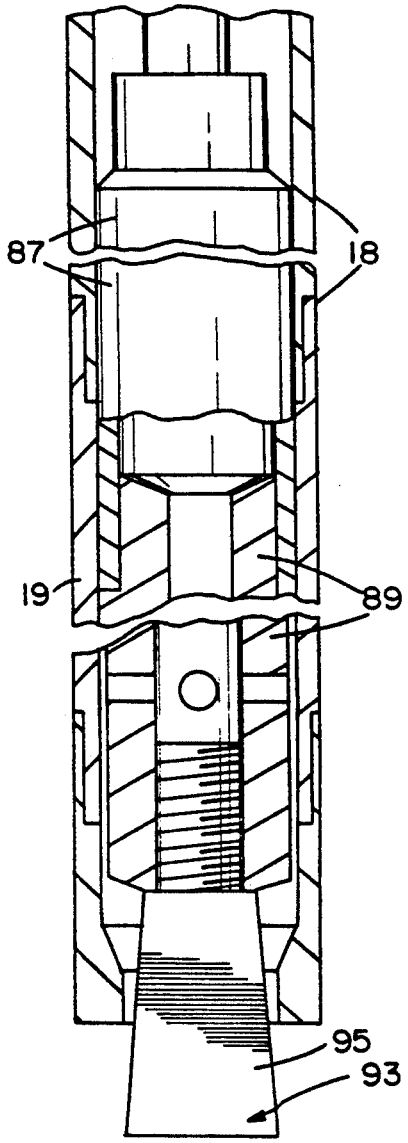
FIG. 5
FIG. 3
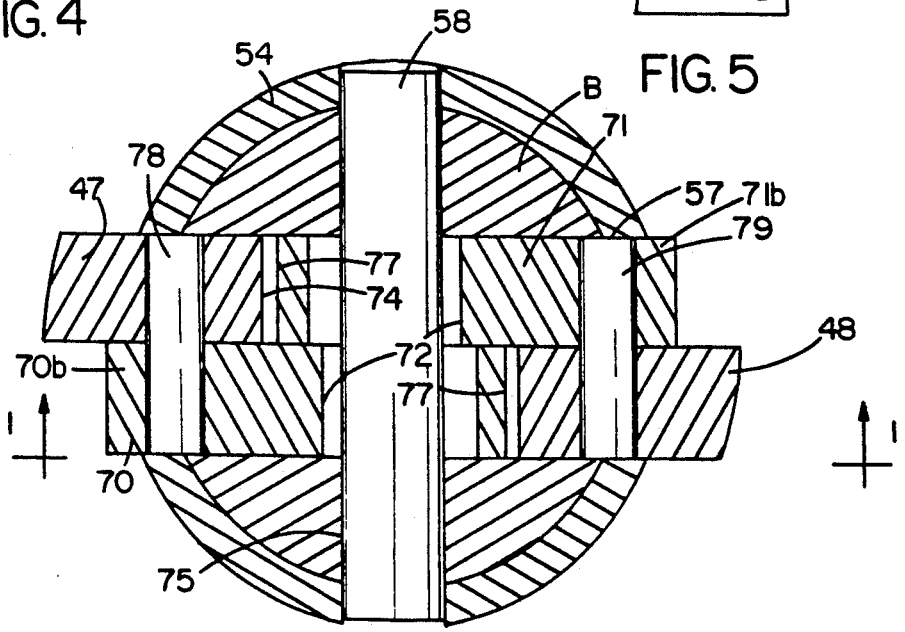

OVERCENTER TOGGLE LATCH APPARATUS

RELATED APPLICATION

This application is a continuation-in-part application of Ser. No. 07/791,847, filed Nov. 14, 1991, now abandoned.

BACKGROUND OF THE INVENTION

The present invention relates to drilling apparatus and more particularly to latch mechanism for releasably retaining a core barrel inner tube assembly, plug bit drilling assembly and similar apparatus in a drill string in an earth formation.

In U.S. Pat. No. 2,905,438 to Church the spearpoint has the one ends of a pair of links pivotally connected thereto, the opposite ends of said links being pivotally connected to the mid-portions of the latches. The one ends of each latch is pivotally connected to the core barrel cap, the upper ends of the latches being movable into a latch seat of a drill string.

U.S. Pat. No. 1,364,254 to Currier discloses an overshot assembly for withdrawing an article through the drill string and having a pair of plates with hanger straps secured thereto and extending thereabove, a jaw pivot extended through axial slots in plate slots, a pair of grappling jaw members pivotally mounted by the jaw pivot with the jaw pivot being axially between the jaws and the upper end of the jaw members, a pair of links having their remote ends pivotally connected to the upper end of the respective jaw member and adjacent ends pivotally connected by a link pivot and a clevis having the link pivot extend therethrough for having a cable or rod secured thereto to retract the clevis. The link pivot is axially movable in slots in the upper ends of hanger straps and is moved upwardly to result in the jaw members moving to a gripping position.

U.S. Pat. No. 3,340,939 to Lindelof discloses a core barrel inner tube assembly having a pin mounted to a latch release tube to move therewith and move into a slot formed by the latches when the latches have moved to their latch seated position for retaining the latches in a latch seated position until a retracting force is applied to the latch release tube. U.S. Pat. No. 4,800,969 to Thompson discloses a latching arrangement similar to Lindelof, other than it does not refer to the pin retaining the latches in a latch seated position.

With core barrel inner tube assemblies such as disclosed in Lindelof and Thomson wherein the latches in their latch seated position are of an axially outwardly opening "V" shape and are retracted by outward movement of the their latch release tubes, the initial axial outward movement of the spearpoint acts to force the latches more tightly against the drill string latch seat shoulder. As a result in, for example, a core blockage situation resulting in the latch body forcing the latches against the latch seat, the pulling force exerted on the spearpoint forces the latches more firmly against the latch seat. This makes it difficult, if possible, to retract the core barrel inner tube assembly through the use of an overshot assembly. For example the pulling force required to be exerted on the latch release tube to retract the latches may be so great that the wire line cable breaks before the latches are moved out of abutting relationship to the latch seat, and thus the core barrel inner tube assembly remains in its latched condition in the drill string with the overshot assembly coupled thereto and part of the broken cable falling downwardly in drill string.

In order to make improvements in latching mechanism for drilling apparatus that includes, for example, wire line core barrel tube assemblies, retractable drag bits and earth sampling tubes that are retractable through a drill string and/or an outer barrel, this invention has been made.

SUMMARY OF THE INVENTION

A drilling assembly that is movable in a drill string to the inner end portion thereof for being latchingly retained therein includes a latch body having latch retracting mechanism mounted thereon for limited axial movement relative thereto for retracting the latches of the latch assembly from a latch seated position against the resilient action of a spring that urges the latches toward the latch seated position. The latch assembly includes an overcenter toggle linkage for locking the pair of pivotally mounted latches in a latch seated position until the assembly overshot coupling member is pulled axially outwardly to move the toggle linkage to an unlocking position. A drilling tool is attached to the latch body to extend inwardly thereof, the tool being any one of, for example, a core barrel inner tube, a plug bit, an earth sampling tube, and etc.

One of the objects of this invention is to provide in drilling apparatus a new and novel latching assembly. A further object of this invention is to provide new and novel latching means for a drilling assembly for lockingly retaining the latches in a latch seated position until the assembly overshot coupling member is moved axially outwardly. An additional object of this invention is to provide new and novel mechanism for lockingly retaining a core barrel inner tube assembly in a drill string until the assembly spearpoint is retracted, and when being retracted, requires less maximum pulling force to be exerted to the overshot coupling portion for retracting the latches from the latch seat.

For purposes of facilitating the description of the invention, the term "inner" refers to that portion of the drill string, or of the assembly, or an element of the assembly being described which in its position "for use" in, or on, the drill string is located closer to the drill bit on the drill string (or bottom of the hole being drilled) than any other portion of the apparatus being described, except where the term clearly refers to a transverse circumferential, direction, or diameter of the drill string or other apparatus being described. The term "outer" refers to that portion of the drill string, or of the assembly, or an element of the assembly being described which in its position "for use" in, or on, the drill string is located axially more remote from the drill bit on the drill string (or bottom of the hole being drilled) than any other portion of the apparatus being described, except where the term clearly refers to a transverse circumferential, direction, or diameter of the drill string or other apparatus being described.

BRIEF DESCRIPTION OF THE DRAWINGS

FIG. 3 is a transverse cross section view generally taken along the lines and the direction of the arrows 3—3 of FIG. 1 other than the central transverse axes of the links and the retractor pin are contained in a common transverse plane perpendicular to the central axis of the drill string;

FIG. 4 is an axial cross sectional view of a portion of the structure shown in FIG. 1 that shows the latches in a latch retracted position as the core barrel inner tube assembly is being retracted through the drill stem; and FIG. 5 is an axial cross sectional view of the inner end portion of a second embodiment of the invention with an axial intermediate portion being broken away, said view showing a drag bit.

Figure 1:
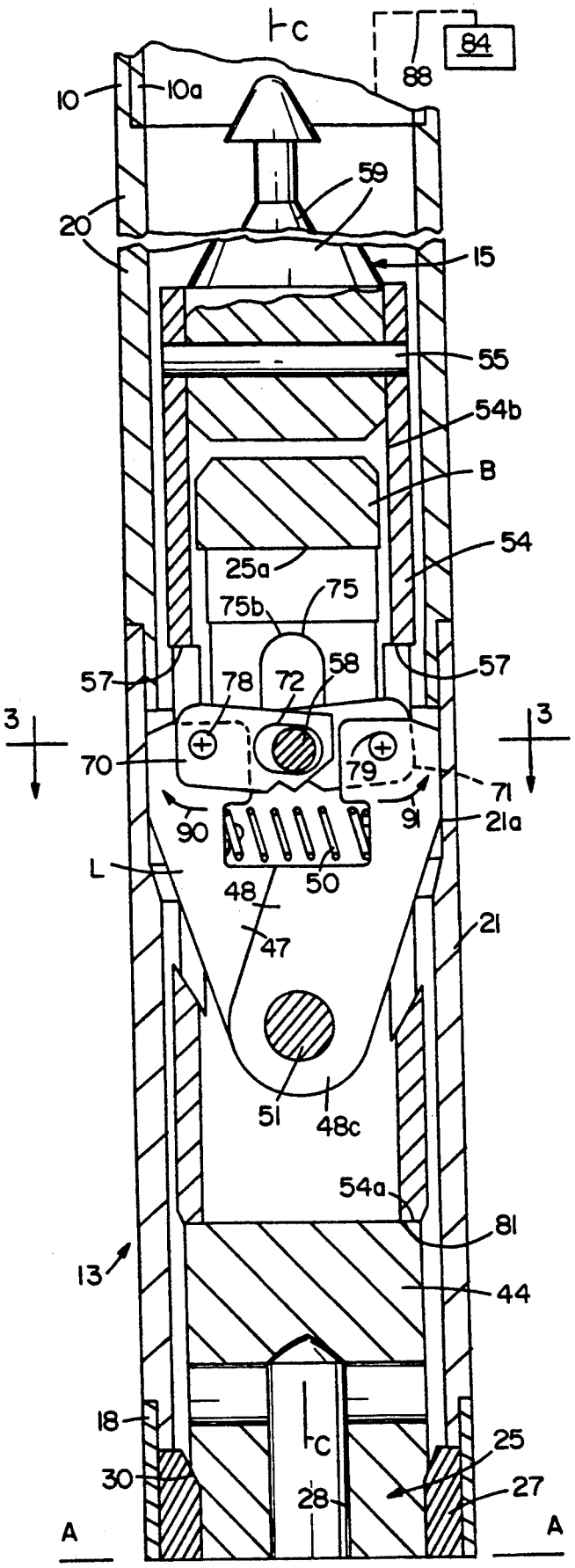
FIGS. 1 and 2 with FIG. 1 arranged above FIG. 2, the axial center lines aligned and lines A—A and B—B aligned, form a composite longitudinal section through the first embodiment of the drilling apparatus with the latches being in a latch seated, toggle linkage overcenter locked position and various axial intermediate portions broken away, these views being generally taken along the line and the direction of the arrows 1—1 of FIG. 3.
Figure 2:
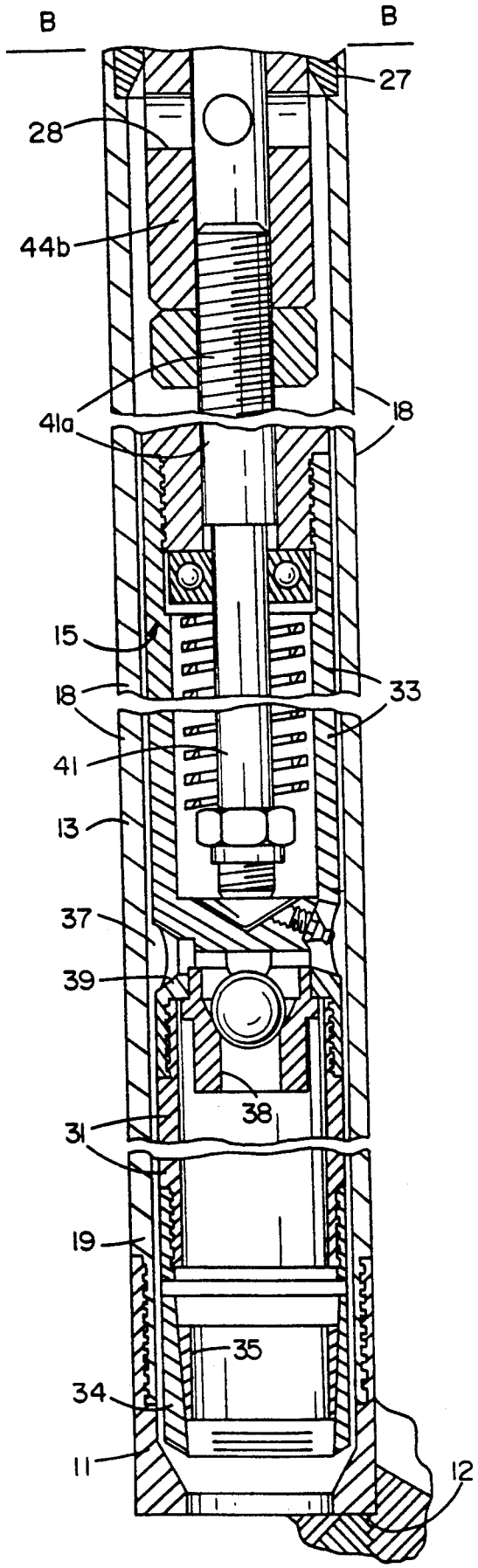

Referring now in particular to FIGS. 1-3, there is illustrated a hollow drill string 10 which is made up of a series of interconnected hollow drill rods (tubes). The drill string 10 is in a downwardly extending bore hole 12 drilled in rock or other types of earth formations by means of an annular core bit 11. The pump apparatus indicated by block 84 pumps fluid under pressure through line 88 into the upper end of the drill string 10 in a conventional manner, the illustrated part of the drill string 10 in FIG. 1 being located just upstream of the bit in the bore hole 12 and may be at a considerable depth below the surface.

The portion of the drill string attached to or extended below the pipe (rod) section 10*a* is commonly referred to as a core barrel outer tube assembly, generally designated 13; the core barrel outer tube assembly being provided for receiving and retaining the core barrel inner tube assembly, generally designated 15. Details of the construction of the core barrel outer tube assembly of the general nature used in this invention may be such as that disclosed in U.S. Pat. Nos. 3,120,282 and 3,120,283. The outer tube assembly is composed of an adaptor coupling 21 that is threadedly connected to the core barrel outer tube 18 to provide a recess in which a landing ring (drill string landing shoulder) 27 is mounted, a reaming shell 19 connected to the inner (lower) end of tube 18 and an annular drill bit 11 at the lower end of the reaming shell for drilling into the earth formation from which the core sample is taken. The upper end of the assembly 13 includes a locking coupling 20 that connects the adaptor coupling to the adjacent pipe section 10*a* of the drill string. At the opposite end of the coupling 20 from the pipe section 10*a*, the locking coupling in conjunction with the annular recess of the coupling 21 form a latch seat 21*a* inside of the surface of the adaptor coupling against which the latches 47, 48 of the latch assembly L are seatable for removably retaining the core barrel inner tube assembly, generally designated 15, adjacent to the core bit. The inner end portion of the locking coupling may have a conventional projection flange (not shown) which extends as a partial cylindrical surface more closely adjacent to the core bit than to the main part of said coupling. This flange bears against a latch to cause the latches and other portions of the inner tube assembly to rotate with the drill string when the latches are in a latched position as is conventional.

The core barrel inner tube assembly 15 includes an axially elongated latch body, generally designated 25, having a main body portion 44 with a conventional annular, downwardly facing shoulder 30 seatable on the landing ring 27 and a fluid bypass channel 28 to permit fluid flow to bypass the landing ring when the shoulder 30 is seated on the ring 27. That is, the portion of the inner tube assembly from the shoulder 30 and axially inwardly thereof is of a smaller diameter than at least the axial part of the main body outwardly of and adjacent-to the shoulder while the channel has a port opening exterior of the latch body outwardly of the shoulder and a second port opening exterior of the latch body inwardly of the shoulder. Suitable valving (not shown) may be provided for blocking flow through the channel, for example of the type referred to in U.S. Pat. No. 3,103,981 to Harper or U.S. Pat. No. 4,800,969 to Thompson.

The assembly 15 also includes a core receiving tube 31, an inner tube cap 33 threaded into the upper end of the core receiving tube, and a spindle and bearing subassembly 41 for connecting the cap to the lower (axial inner) portion of the latch body. The subassembly 41 includes a spindle bolt 41*a* threadedly connected to the inner end portion 44B of the latch body, and connects the cap to the latch body for limited movement in a conventional manner. The core receiving tube has a replaceable core lifter case 34 and a core lifter 35, the structure and function of which may be generally the same as set forth in U.S. Pat. No. 2,829,868. A fluid passageway 39 formed in the cap 33 opens through a valve subassembly 38 to the interior of the outer end of the core receiving tube and at the opposite end to the annular clearance space 37 between the inner tube assembly and the outer tube 18 that forms a part of the annular fluid channel 37 to, in conjunction with the bypass channels, permit fluid to bypass the inner tube assembly when in a core taking position such as illustrated in FIG. 1-3. The cap 33 is mounted by the spindle-bearing subassembly 41, the subassembly 41 and the manner of the mounting thereof being very similar to that described in greater detail in U.S. Pat. No. 3,305,033.

The core barrel inner tube assembly also includes a latch assembly L having a pair of latches 47, 48 with their lower end portions 47*c*, 48*c* pivotally mounted in a latch body slot 25*a* by a pivot member 51 that is mounted by the latch body, and a spring 50 for constantly resiliently urging the latches to pivot to their latch seated positions. A latch retractor (release) tube 54 is mounted by the latch body for limited axial movement relative thereto for retracting the latch assembly from its latch seated position and alternately permitting the latch assembly moving to its latch seated position when the latches are adjacent to the latch seat, while a pin 55 is mounted in a fixed position relative to the latch release tube. The pin 55 mounts the overshoot coupling member (spearpoint) 59 to the outer end portion 54*b* latch release tube for moving the latch release tube axially outwardly when the overshoot coupling member is moved axially outwardly.

The latch assembly L also includes a toggle linkage subassembly having generally transversely elongated toggle links 70, 71. Parallel transverse pivot link pins 78, 79 mount the radial outer ends 70*b*, 71*b* of the links 70, 71 to the outer end portions 47*b*, 48*b* of the latches 47, 48 respectively for pivotal movement between an overcenter locked position of FIG. 1 and the latch retracted position of FIG. 4. The radial inner end portion of each link has a transversely elongated slot 72 formed therein with a horizontally extending retractor pin 58 extended transversely through the generally transversely elongated link slots 72 and the axially elongated slots 75 of the latch body, the opposite ends of the pin 58 being mountingly retained within opposed apertures in the latch release tube to move therewith and form a lost motion pivotal connection between the latch body, the latches and the retractor member (overshot coupling portion and the latch retractor tube). The axial outward movement of the latch release tube relative to the latch body is limited by the retractor pin abutting against the upper edges of the latch body that in part define slots 75. Advantageously the links and latches respectively are of the same construction and are oppositely faced as in part shown in the drawings.

The central axis of the retractor pin 58 is parallel to the pivot axes of link pivot pins 78 and 79 and transversely therebetween. The pivotal movement of the radial inner ends of the links 70, 71 relative to the latch body in a predominantly inward direction (arrows 90 and 91 respectively) is limited by the retractor pin bottoming on the lower edges of slots 75. When the core barrel inner tube assembly is in its core taking position of FIGS. 1 and 2 with the latches in their latch seated position, the lower annular edge 54*a* on the upwardly facing shoulder of the latch body, and the central axis of the pin 58 is below the transverse plane (plane perpendicular to the central axis C—C of the drill string, the latch body and latch retractor tube) that contains the axes of the pivots 78, 79. At this time the links prevent the outer end portions of the latches pivoting sufficiently radially inward toward one another (at least in part due to the transverse dimensions of the link slots) to permit the latches moving axially outwardly of the latch recess 21*a* until the latch release tube is pulled axially outwardly to move the retractor pin outwardly. That is, the dimensions of the slots 72 and 75 are such that when the latches' axial outer end portions abut against the axially extending surface of the latch seat, the retractor pin axis can axially move a limited amount above and below the plane of the pivot axes of the link pivots without pivoting the latches.

The second embodiment, generally designated 93, includes the latch body, the latch assembly and the latch retracting mechanism of FIGS. 1, 3 and 4. However, instead of the spindle subassembly 41, there is provided a conventional earth sampler spindle 87 that at its outer end is threadedly connected to the inner end of the latch body B and at its inner end is threadedly connected to a drag bit mounting sub 89. The sub 89 threadedly mounts a drag bit 95 to extend through and inwardly of the drill bit 11. The sub is of a type that it rotates the drag bit when the bit 11 is rotated.

In using the apparatus of this invention, for example, the core barrel inner tube assembly 15 of the first embodiment, the assembly 15 is inserted into the outer end of the drill string and as the assembly moves inwardly (axially downwardly), the transverse inner surface of the drill string limits the movement of the latches such that they remain adjacent to their retracted positions of FIG. 4 if being lowered by a wire line overshot assembly, or if free falling through the drill string, the latches abut against the drill string with the retractor pin slightly below the upper edges of the slots 75 but much closer to the upper edges than the lower edges. At this time the pin 58 or the lower edges of the latch slots 57 in the retractor tube that the latches extend through in their latch seated position, prevent the latch release tube moving to have its edge 54*a* abut against the shoulder 81 but do not prevent the latches initially moving toward their latch seated position. As the latch body moves to seat on the landing ring, the latches move radially adjacent to the latch seat whereby the latches can pivot toward their latch seated position and the latch retractor tube can move axially inwardly toward the shoulder 81. Accordingly, the retractor pin moves axially inwardly toward the shoulder 81 as the latches pivot toward their latch seated position and the latch release tube moves to a position under gravity to a position to abut against shoulder 81, the outer ends 47*b*, 48*b* of the latches pivoting radially outwardly to seat in the latch seat as a result of the provision of the spring 50. It is noted that the length of the slots 75 are such that the retractor pin moves axially inwardly to the axial inner ends 75*c* thereof even though the latch release tube seats on the shoulder 81 and the outer ends of latches abut against the axially extending, radial outer surface that in part defines the latch seat. At this time the movement of the latches results in the links pivoting in the direction of the arrows 90, 91 respectively relative to the outer ends of the latches and continue to pivot in such directions after the pivotal extending movement of the latches is stopped by abutting against the axial wall of the latch seat, until the transverse central axis of the retractor pin 58 is below axes of the link pivots 78, 79. The dimensions of the pin 58 relative to the dimensions of the slots 72 are such to permit movement of the latches and the links as at least in part are indicated above.

When the latches and the toggle link assembly are in the latch seated, toggle link assembly locked position of FIG. 1, an axial outwardly directed force on the latch body urges the latches to move outwardly to abut against the outer annular, generally transverse edge of the latch seat, if not already in such a position. However, the latches can not pivot sufficiently away from their latch seated position for permitting the latch body moving axially outwardly of the latch seat since the axial outward forces on the latches exert such forces on the link pins 78, 79 that result in the links being moved to have the radial outer ends of the slots 72 (ends most closely adjacent to the respective link pivot) abut against the retractor pin to urge the pin axially downwardly since the central axis of the retractor pin is below the plane of central axes of the link pins. Such movement of the retractor pin is prevented by the retractor pin bottoming on the bottom edges of the slots 75, and accordingly the latches can not pivot about the latch pivot 51 to have their outer ends sufficiently radially closely adjacent to one another that the latches can move axially outwardly of the latch seat. Thus the latch body remains in the latch seated position even though, for example, the drill bit drills into high pressure gas or water that would otherwise blow the core barrel inner tube assembly out of the drill stem.

Each of the latches and the links in their locked, latch seated position have generally radial inner, axially extending edges 74, 77 respectively, the edges 74 being provided on the axial outer end portions of the latches. The transverse dimensions of the links may be such that the edge 77 of link 70 abuts against the edge 74 of latch 48 and that edge 77 of link 71 abuts against the edge 74 of latch 47 to limit the pivotal movement of the outer end portions of the latches toward one another sufficiently to permit the latches moving axially outwardly of the latch seat and thereby allow the latch body being withdrawen from the latch seat until the central axis of the retractor pin is moved axially outwardly of the transverse plane containing the pivot axes of the pivots 78, 79. Thus, the movement of the outer end portions of the latches radially inwardly is sufficient to permit the latch body and the structure depending from the latch body being withdrawn from the drill string, may be as described in the preceding paragraph, or by the radial inner ends of the links abutting against edges 74, or both. Regardless of whether the the outer end portions of the latches move toward one another sufficiently to permit retraction of the latch body when the latches extend within the latch recess of the drill stem is limited by the transverse outer edges of the slots 72 abutting against the retractor pin, or at least one of the edges 74 abuts against the respective edge 77, or both, until the retractor tube is retracted the central axis of the retractor pin remains below the transverse plane of the links pins and the latches are lockingly retained in their locked latch seated position.

During the core taking step, the downward drill force on the drill string is transmitted through the latches to the pivot member 51 and therethrough to the latch body. Usually after a core jam or the core receiving tube has taken the desired axial length of core, the drill string is retracted a short distance as is conventional and a suitable wire line overshot assembly (not shown) is lowered or allowed to move axially inwardly to couple onto the coupling portion 59. Then, upon retracting the overshot coupling member, the retractor tube is retracted to move the retractor pin outwardly, the link slots being of dimensions to permit axial movement of pin 58 in the latch slots without exerting radial outward forces through the links to the pins 78, 79 as the central axis of the retractor pin is moved from axially inwardly of the plane of the central axes of the pins 78, 79 to a position above the central axes of pins 78, 79 (the inner ends of the links 70, 71 pivoting in the directions opposite of the arrows 90, 91 respectively).

Further retraction of the overshot coupling member results in the movement of the retractor pin relative to link slots 72 to abut against the end of the respective slot 72 that is the most remote from pivot 78, 79 for the respective link to continue the movement of the radial inner ends of links whereby a pulling force is exerted on the pivots 78, 79 to move the pivots 78, 79 outwardly and radially toward one another for pivoting the latches out of the latch seat and toward their retracted position. This permits retracting the latch body and the structure depending therefrom prior to the retractor pin abutting against the axially outer end of the latch body slots 75. The retractor pin in abutting against the outer ends 75*b* of the slots 75 retracts the latch body as the overshot coupling member is moved further axially outwardly.

Even though as disclosed above there is provided a single latch pivot, it is to be understood that there may be provided two latch pivots in parallel relationship with one latch being pivotally mounted by each latch pivot as long as the latch pivots and the link pivots are located such that the links in moving from their latch retracted position to their latch seated position, the links adjacent ends and the retractor pin move to an overcentered latch seated locking position.

Further, even though the links have been described as having radial inner, transversely elongated slots 72, it is to be understood that oversized holes can be used in place of the slots 72 as long as the holes are of a size sufficiently larger than the outer diameter of the retractor pin to permit movement of the links relative to the retractor pin and the slots 75 for the latch assembly to function as described in this application. For example the oversize holes may be about 1/16" larger than the outer diameter of the retractor pin. Thus the use of the term "slot" with reference to the slots 72 is to be understood to encompass oversized holes that perform the same function as the slots 72.

Also it is to be understood that the spring 50 is not required for pivoting the latches from their latch retracted position to their latch seated position since when the inner tube assembly free falls through the drill string, or is lowered by an appropriate overshot assembly, upon moving axially adjacent to or seating on the landing ring, the weigh of the latch retractor tube and the coupling member 59 acts to move the retractor pin downwardly. Thus, at least in part due to the weight acting through the retractor pin and the links diverging in a downward direction from the retractor pin, the outer ends of the latches are force radially away from one another to their latch seated position when the latches are adjacent to the latch seat.

What is claimed is:

1. A wireline drilling apparatus that has a central axis and that is movable axially inwardly through a drill string toward a bit end of the drill string to seat on a drill string landing shoulder and latchingly engage a drill string latch seat and is retractable axially outwardly through the drill string in a direction away from the bit end of the drill string, said drill string having a central axis, comprising: an axially elongated latch body having an axial outer end portion, an axial inner end portion and a shoulder seatable on the landing shoulder; a drilling tool mounted to the inner end portion of the latch body; a latch assembly comprising a first and a second latch, each latch having an axial outer end portion and an axial inner end portion; and first, generally transverse, latch pivot means mounting the inner end portions of the latches to the latch body to mount the latches for pivotal movement relative to the latch body between a latch seated position seatable in the latch seat to block movement of the latch body axially outwardly through the drill string and a retracted position permitting the latch body moving axially through the drill string, and retractor means mounted to the latch body for limited axial movement relative to the latch body between an axial inner position relative to the latch body and an axial outer position relative to the latch body, and in operative relationship with the latch assembly for moving the latches from the latch seated position to the latch retracted position while moving axially outwardly relative to the latch body and after moving the latches away from their latch seated position, axially retracting the latch body through the drill string and thereby the drilling tool; the retractor means having an axial outer overshot coupling portion and a second portion extending axially inwardly of the overshot coupling portion and the latch assembly including locking means mounted for movement with the latches and relative to the latches and connected to the latches for, after the latches have moved from the latch retracted position to their latch seated position, lockingly retaining the latches in their latch seated position until the retractor means is moved axially outwardly relative to the latch body and after the latches have been locked in their latch seated position, for retracting the latches from their latch seated position when the retractor means is moved axially outwardly; said locking means being connected to the retractor means and at least in part being mounted to the latches to move with the latches and relative to the latches; the locking means including a first link having a first end portion and a second end portion radially inwardly of the first end portion of the first link and radially more closely adjacent to the outer end portion of the second latch than the first end portion of the first link when the first latch is in its latch seated position; a first transverse pivot pivotally connecting the first end portion of the first link to the outer end portion of the first latch; a second link having a first end portion and a second end portion, the second end portion of the second link being radially inwardly of the first end portion of the second link when the second latch is in its latch seated position; and a second transverse pivot pivotally connecting the first end portion of the second link to the outer end portion of the second latch; each of the first and second pivots having a transverse pivot axis that is transversely spaced from the other, and the retractor means including second pivot means having a transverse pivot axis parallel to and transversely intermediate the pivot axes of the first and second pivots for pivotally connecting the second end portions of the first and second links to the second portion of the retractor means; said second pivot means being connected to the retractor means for movement with the retractor means and movement relative to the latches between a position that the second means pivot axis is axially inwardly of the pivot axes of both of the first and second pivots to retain the latches in their latch seated position and a position that is axially outwardly of the pivot axes of both of the first and second pivots to permit the latches moving to their retracted position and for retracting the latches when the retractor means is moved axially outwardly relative to the latch body.

2. A wireline core barrel apparatus of claim 1 wherein the latch body has a slot that is axially elongated in the direction of elongation of the latch body, said slot having an axial outer edge and an axial inner edge, and the second pivot means comprises a retractor pin extending into the latch body slot for axial movement in the latch body slot, said retractor pin being axially moved in the latch body slot as the overshot coupling portion is moved axially relative to the latch body.

3. A wireline core barrel apparatus of claim 2 wherein the latch body has a central axis of elongation; the retractor pin has a transverse central axis; and the first and second pivot axes are located in a common plane that extends generally perpendicular to the central axis of the latch body and are parallel to one another and to the retractor pin axis, the retractor pin axis being axially inwardly of the common plane of the first and second pivot axes when the latches are in their latch seated position and the retractor pin axis being axially outwardly of the common plane of the first and second pivot axes when the latches are in their latch retracted position; and the retractor pin abuts against the latch body slot axial outer edge after the latches have been moved to their latch retracted position for retracting the latch body as the overshot coupling portion is moved axially outwardly.

4. A wireline core barrel apparatus of claim 3 wherein the drilling tool comprises a core receiving tube.

5. A wireline core barrel apparatus of claim 3 wherein the drilling tool comprises a drag bit.

6. A wireline drilling apparatus having an axially extending central axis and being movable axially inwardly through a drill string toward a bit end of the drill string to a position adjacent to the bit end of the drill string to latchingly engage a drill string latch seat and is retractable axially outwardly through the drill string in a direction away from the bit end of the drill string, said drill string having a central axis, comprising: an axially elongated latch body having an axially extending central axis, an axial outer end portion and an axial inner end portion; a drilling tool mounted to the inner end portion of the latch body; an axially extending latch retractor for retracting the latch body, said latch retractor being mounted for limited axial movement relative to the latch body between an axial inner position relative to the latch body and an axial outer relative to the latch body and having an axial outer overshot coupling portion; a first latch pivot mounted to the latch body; a first latch mounted to the latch pivot for movement between a latch seated position for releasably retaining the latch body in the drill string and a latch release position permitting the latch body being retracted through the drill string, the latch having an axial outer end portion and an axial inner end portion mounted to the latch body by the latch pivot; and locking means interconnected between the outer end portion of the latch, the retractor and the latch body for facilitating the movement of the latch to its latch seated position when the latch is axially adjacent to the latch seat in the drill string and after the latch has moved to its latch seated position, to lockingly retain the latch in a latch seated position until the retractor is moved axially outwardly relative to the latch body, and acting in cooperation with the latch retractor for moving the latch from its latch seated position to its latch release position when the latch retractor is moved axially outwardly relative to the latch body and thence retract the latch body through the drill string; the latch pivot has a transverse central pivot axis; and the locking means includes a first link having a first end and a second end, the second end of the first link being radially inwardly of the first end of the first link when the latch is in its latch seated position, a link first pivot pivotally connecting the first end of the first link to the outer end portion of the latch and having a transverse central axis, and a link second pivot pivotally connecting the second end of the first link to the retractor; said link second pivot having a transverse central axis axially inwardly of the central axis of the link first pivot when the locking means lockingly retains the latch in the latch seated position; and the central axis of the link second pivot is axially outwardly of the pivot axis of the link first pivot when the latch body is being retracted through the drill string.

7. A wireline core barrel apparatus of claim 6 wherein the locking means includes a second latch mounted to the latch pivot for pivotal movement, the second latch having an axial inner end portion pivotally mounted to the latch pivot and an axial outer end portion, and overcenter means forming a lost motion pivotal connection between the second end of the first link, the outer end portion of the second latch and the retractor for moving the second latch and the first link to move the first latch relative to the latch body between the latch seated and latch retracted positions; and the overcenter means includes the link second pivot.

8. A wireline core barrel apparatus of claim 7 wherein the link second pivot comprises a retractor member; the retractor includes a retractor tube connected to and extending axially inwardly of the overshot coupling portion and in axial movable relationship relative to the latch body, said retractor tube mounting the retractor member in a fixed axial relationship relative thereto; and the latch body has a slot elongated in the direction of elongation of the latch body, the latch body slot having the retractor member extended therein for limiting the axial movement of the latch body relative to the retractor tube.

9. A wireline core barrel apparatus of claim 8 wherein the second end of the link has an elongated slot, said slot having the retractor member extended therethrough to permit limited movement of the link generally radially relative to the retractor member.

10. A wireline core barrel apparatus of claim 6 wherein the first link is a first toggle link; and the locking means includes an overcenter toggle linkage having the first toggle link, the link first pivot, the link second pivot, a second toggle link having a first end and a second end, the second end of the second link being radially inwardly of the first end of the second link and radially more closely adjacent to the first end of the first link when the locking means lockingly retains the latch in the latch seated position, and means for pivotally connecting the first end of the second link to one of the latch pivot and the latch body; the link second pivot pivotally connecting the second end of the second link to the second end of the first link.

11. A wireline core barrel apparatus of claim 10 wherein the means for pivotally connecting the first end of the second link comprises a second latch that is pivotally mounted to the latch body for movement relative to the latch body between a latch seated and a latch retracted position, the second latch having an axial outer portion and an axial inner portion, and a link third pivot pivotally connecting the first end of the second link to the outer end portion of the second latch.

12. A wireline core barrel apparatus of claim 11 wherein the retractor is movable between an axial inner position relative to the latch body to permit the latches moving to their seated position and an axial outer position relative to the latch body; the outer end portions of the latches pivoting radially toward one another when the latches move from a latch seated position to latch retracted position; and the first latch and the second link have edges for cooperating with one another to limit the movement of the outer end portions of the latches radially toward one another to a spacing sufficiently great to preclude the latches moving from their latch seated position toward their latch retracted position sufficiently to permit the latch body being moved axially outwardly of the latch seat until after the retractor is moved axially outwardly from the retractor axial inner position relative to the latch body.

13. A wireline core barrel apparatus of claim 11 wherein the link second pivot comprises a retractor pin having the pivot axis of the link second pivot; the link third pivot has a transverse pivot axis; the inner end portion of the second latch is pivotally mounted on the latch pivot; the pivot axis of the link first pivot, the pivot axis of the third link pivot and the retractor pin axis are parallel to one another; the pivot axis of the link first pivot and the pivot axis of the link third pivot are contained in a plane substantially perpendicular to the latch body central axis, and the second ends of the links have generally transversely elongated slots; and the retractor pin is extended through the link slots to form a lost motion pivotal connection between the retractor pin and the links whereby the retractor pin axis can be moved axially through said plane as the latches move between their latch seated and latch retracted positions.

14. A wireline core barrel apparatus of claim 13 wherein the drilling tool comprises one of a core receiving tube and a drag bit.

15. A wireline core barrel apparatus of claim 13 wherein the latch body includes a slot elongated in the direction of elongation of the latch body, the latch body slot having the retractor pin extended therethrough for limiting the axial movement of the retractor pin relative to the latch body; and the retractor includes a retractor tube mounted for movement relative to the latch body, the retractor tube mounting the retractor pin in a fixed axial position relative to the retractor tube.

16. A wireline drilling apparatus that has an axial extending central axis and that is movable axially inwardly through a drill string to a position adjacent to the axial inner bit end of the drill string to latchingly engage a drill string latch seat and is retractable axially outwardly through the drill string in a direction away from the bit end of the drill string, comprising: an axially elongated latch body having an axially extending central axis, an axial outer end portion and an axial inner end portion; a drilling tool mounted to the latch body axial inner end portion; an axially extending latch retractor mounted for limited axial movement relative to the latch body between an axial inner position and an axial outer position, said retractor having an axial outer overshot coupling portion; a first latch pivot; a first latch mounted to the latch body by the latch pivot for movement between a latch seated position for releasably retaining the latch body in the drill string and a latch release position permitting the latch body being retracted through the drill string, the latch having an axial inner end portion pivotally connected to the latch body by the latch pivot and an axial outer end portion; and retaining means interconnected between the outer end portion of the latch, the retractor and the latch body for moving the latch to its latch seated position when the latch is axially adjacent to the latch seat in the drill string to retain the latch in a latch seated position once the latch has moved to its latch seated position, and acting in cooperation with the retractor for moving the latch from its latch seated position to its latch release position when the retractor is moved axially outward relative to the latch body and after the latch has been moved from its latch seated position, move the latch body axially outwardly as the retractor is retracted; the retaining means including overcenter means operable between a latch locking position to lock the latch in its latch seated position when the retractor is in its axial inner position relative to the latch body and a latch retracted position permitting retraction of latch body through the drill string when the retractor is in its axial outer position relative to the latch body, the overcenter means being connected to the retractor for movement with the retractor and relative to the retractor; the overcenter means including a first link having a first end and a second end, the second end of the first link being radially inwardly of the first end of the link and more closely adjacent to the central axis of the latch body than the first end of the first link when the latch is in its latch seated position, limit means for cooperating with the first link when the latch is in its latch seated position for preventing the latch moving to its release position until the retractor is moved axially outwardly relative to the latch body and a first link pivot pivotally connecting the first end of the first link to the outer end portion of the latch for movement with the latch and relative to the latch between a position that the second end of the link is abuttable against the limit means to block movement of the latch from its latch seated position to the latch release position; said first link being pivoted relative to the latch when the retractor is moved axially outwardly to pull the latch to its released position;

17. A wireline core barrel apparatus of claim 16 wherein the limit means includes a second latch pivotally mounted to the latch body for movement between latch release and latch seated positions, a second link having a first end pivotally connected to the second latch and a second end, and pivot means for pivotally connecting the second ends of the first and second link together for movement between an overcenter locking position to retain the latches in their latch seated position and an unlocked position moving the links to move the latches out of their latch seated position when the retractor is moved axially outwardly relative to the latch body.

18. A wireline drilling apparatus that has an axial extending central axis and that is movable axially inwardly through a drill string to a position adjacent to an axial inner bit end of the drill string to latchingly engage a drill string latch seat and is retractable axially outwardly through the drill string in a direction away from the bit end of the drill string, comprising: an axially elongated latch body having an axial outer end portion and an axial inner end portion; a drilling tool mounted to the inner end portion of the latch body; an axially extending latch retractor mounted for limited axial movement relative to the latch body, said latch retractor having an axial outer overshot coupling portion; a first latch pivot having a transverse pivot axis; a first latch mounted to the latch body by the latch pivot for movement between a latch seated position for releasably retaining the latch body in the drill string and a latch release position permitting the latch body being retracted through the drill string; said latch having an axial outer end portion for latchingly engaging the latch seat and an axial inner end portion pivotally mounted to the latch pivot; and interconnecting means interconnected between the latch, the retractor and the latch body for permitting the latch moving to its latch seated position when the latch is axially adjacent to the latch seat in the drill string, and acting in cooperation with the retractor for pulling the latch from its latch seated position to its latch release position when the retractor is moved axially outwardly relative to the latch body; the interconnecting means including a first link having a first end and a second end, the second end of the first link being radially inwardly of the first end of the first link and more closely adjacent to the latch body central axis than the first end of the first link when the latch is in its latch seated position, a first link pivot pivotally connecting the first link to the latch for movement with the latch and relative to the latch, the first link pivot having a transverse pivot axis parallel to the latch pivot axis and pivotally connecting the first end of the first link to the latch axially outwardly of the latch pivot, and pivot means for pivotally connecting the second end of the link to the retractor and being moved axially outwardly by the retractor as the retractor is moved axially outwardly relative to the latch body; the pivot means having a transverse pivot axis that is parallel to the latch pivot axis and axially inwardly of the pivot axis of the first link pivot when the latch is in the seated position of the latch and axially outwardly of the pivot axis of the first link pivot when the latch is in the release position of the latch.

19. A wireline core barrel apparatus of claim 18 wherein there is provided a second latch that is mounted to the latch body by the latch pivot for pivotal movement between a latch seated position for acting in cooperation with the first latch to releasably retain the latch body in the drill string and a latch release position permitting the latch body being retracted through the drill string; the second latch having an axial outer end portion for latchingly engaging the latch seat and an axial inner end portion pivotally mounted to the latch pivot; a second link having a first end and a second end radially inwardly of the first end of the second link when the second latch is in the latch seated position of the second latch; and a second link pivot pivotally connecting the second link to the second latch for movement with the second latch and relative to the second latch; the second link pivot having a transverse pivot axis parallel to the latch pivot axis and pivotally connecting the first end of the second link to the second latch axially outwardly of the latch pivot; the pivot means pivotally connecting the second end of the second link to the retractor.

* * * * *